US006567620B2

(12) United States Patent
Brown, Jr. et al.

(10) Patent No.: US 6,567,620 B2
(45) Date of Patent: May 20, 2003

(54) IMAGE FORMING APPARATUS WITH VARIABLE GAP SIZE BASED ON RECORDING MEDIA SUPPLY LEVEL

(75) Inventors: William Frank Brown, Jr., Lexington, KY (US); Daniel Paul Cahill, Verona, KY (US); Benjamin Charles DeVore, Lexington, KY (US); Rodney Lee Jensen, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/965,301

(22) Filed: Sep. 27, 2001

(65) Prior Publication Data

US 2003/0059222 A1 Mar. 27, 2003

(51) Int. Cl.[7] ..... G03G 15/00
(52) U.S. Cl. ..... 399/18; 399/23; 399/388
(58) Field of Search ..... 399/18, 23, 75, 399/76, 388, 396, 394; 271/256, 259, 258.01; 346/134

(56) References Cited

U.S. PATENT DOCUMENTS

| | | | | |
|---|---|---|---|---|
| 5,056,771 A | | 10/1991 | Beck et al. | |
| 5,121,914 A | | 6/1992 | Hargreaves | |
| 5,257,082 A | | 10/1993 | Kobayashi et al. | |
| 5,325,166 A | | 6/1994 | Hamilton et al. | |
| 5,415,387 A | | 5/1995 | Suzuki | |
| 5,423,527 A | | 6/1995 | Tranquilla | |
| 5,461,468 A | | 10/1995 | Dempsey et al. | |
| 5,897,112 A | | 4/1999 | Kwag | |
| 5,915,690 A | | 6/1999 | Surya | |
| 5,953,559 A | * | 9/1999 | Obu | 399/110 |
| 5,960,230 A | | 9/1999 | Peter | |
| 5,964,460 A | | 10/1999 | Azumi et al. | |
| 5,966,555 A | * | 10/1999 | Nakajima et al. | 399/18 |
| 6,023,034 A | | 2/2000 | Nakajima et al. | |
| 6,076,821 A | | 6/2000 | Embry et al. | |
| 6,125,242 A | | 9/2000 | Yamada | |
| 6,157,791 A | | 12/2000 | Haines et al. | |
| 6,179,281 B1 | | 1/2001 | Pilsl et al. | |
| 6,493,518 B2 | * | 12/2002 | Park | 399/23 |

FOREIGN PATENT DOCUMENTS

| | | | |
|---|---|---|---|
| JP | 2001-5253 A | * | 1/2001 |
| JP | 2001-66949 A | * | 3/2001 |

* cited by examiner

*Primary Examiner*—Joan Pendegrass
(74) *Attorney, Agent, or Firm*—Coats & Bennett, P.L.L.C.

(57) ABSTRACT

Toner is conserved in an image forming apparatus, such as an electrophotographic printer (e.g., laser printer), by varying the interpage gap when approaching an exhaustion of the recording media supply ("paper out"). A supply level sensor is used to determine whether the supply of discrete recording media (e.g., paper sheets) is above or below a predetermined level. A smaller value interpage gap is used when the supply level is above the predetermined level. The interpage gap is automatically lengthened to a second larger value when the sensed media supply level drops below the predetermined level. The longer second interpage gap allows for "paper out condition" that may result from printing of sheet N−1 to be determined prior to image formation beginning for sheet N. The interpage gap may be reset to the smaller value when the supply has been refilled to above the pre-determined level.

17 Claims, 3 Drawing Sheets

IMAGE FORMING APPARATUS WITH VARIABLE GAP SIZE BASED ON RECORDING MEDIA SUPPLY LEVEL

BACKGROUND OF THE INVENTION

The present invention relates generally to the field of image forming, and more particularly to an image forming apparatus that varies the spacing between successive recording media based on the recording media supply level.

One of the carefully controlled functions in an image forming apparatus, such as a laser printer, is the control of the relative timing of image formation and the feeding of recording media. For laser printers using an intermediate transfer module in particular, coordination of the toner image formation on the photoconductors and/or intermediate transfer module and the feeding of paper to be printed so that both arrive at the appropriate transfer point at the same time is an important function. This task may be complicated somewhat, particularly in prior art multi-color printers, by the physical path lengths involved. In particular, it is common for the image path length between the farthest upstream toner cartridge and the relevant transfer point to be longer than the paper feed path length between the paper supply and the relevant transfer point. As such, it is common for toner image formation to start for a particular sheet before that sheet is "picked" from the paper supply. That is, the image formation at that toner cartridge for sheet N begins substantially before the picking of the sheet N from the paper supply is initiated. Indeed, due to the geometries involved, the image formation for sheet N is typically initiated while the sheet N−1 is still being fed from the paper supply. As such, prior art devices often begin forming an image before it is possible to determine if the paper supply is empty. If this occurs, then toner is unnecessarily wasted.

SUMMARY OF THE INVENTION

The present invention provides a method and apparatus for conserving toner in an image forming apparatus, such as a laser printer, by varying the interpage gap when approaching an exhaustion of the recording media supply (e.g., a paper out condition). A supply level sensor is used to determine whether the supply of discrete recording media (e.g., paper sheets) is above or below a predetermined level, such as 5% or 10%. When the supply level is above the predetermined level the printer operates normally. That is, the interpage gap is at a first value, say two inches. With this arrangement, it is necessary for image formation for sheet N to begin prior to when a "paper out condition" would result from printing sheet N−1. When the sensed media supply level drops below the predetermined level, the interpage gap is automatically lengthened to a second value, such as approximately thirteen inches. This longer interpage gap allows for the exhaustion of the recording media supply that may result from printing of sheet N−1 to be determined prior to image formation beginning for sheet N. The interpage gap may be increased by allowing the ITM belt to continue moving, but without adding the image for sheet N+1 until after the "paper out" would normally be sensed. For instance, the relative timing between the start of image formation and the picking of the corresponding sheet may be maintained (to maintain proper alignment at the relevant transfer point), but the start of image formation may be delayed until the "paper out" would be detected if it exists after printing sheet N−1. If a "paper out" condition is detected, the printer responds as usual (e.g., alerts user), but toner waste is reduced. This longer interpage gap/slower throughput process should be used when the media supply level is low, so that higher throughput is available for the majority of the time. The interpage gap may be reset to the normal value when it has been detected that the supply has been refilled to above the pre-determined level.

DETAILED DESCRIPTION OF THE INVENTION

As the present invention relates to the process flow of various materials in an electrophotographic image forming apparatus, an understanding of the basic elements of an electrophotographic image forming apparatus may aid in understanding the present invention. For purposes of illustration, a four cartridge color laser printer will be described; however one skilled in the art will understand that the present invention is applicable to other types of electrophotographic image forming apparatuses that use one or more toner colors for printing. Further, for simplicity, the discussion below will use the terms "sheet" and/or "paper" to refer to a discrete unit of recording media 5; this term is not limited to paper sheets, and any form of discrete recording media is intended to be encompassed therein, including without limitation, envelopes, transparencies, postcards, and the like.

Figure 1:
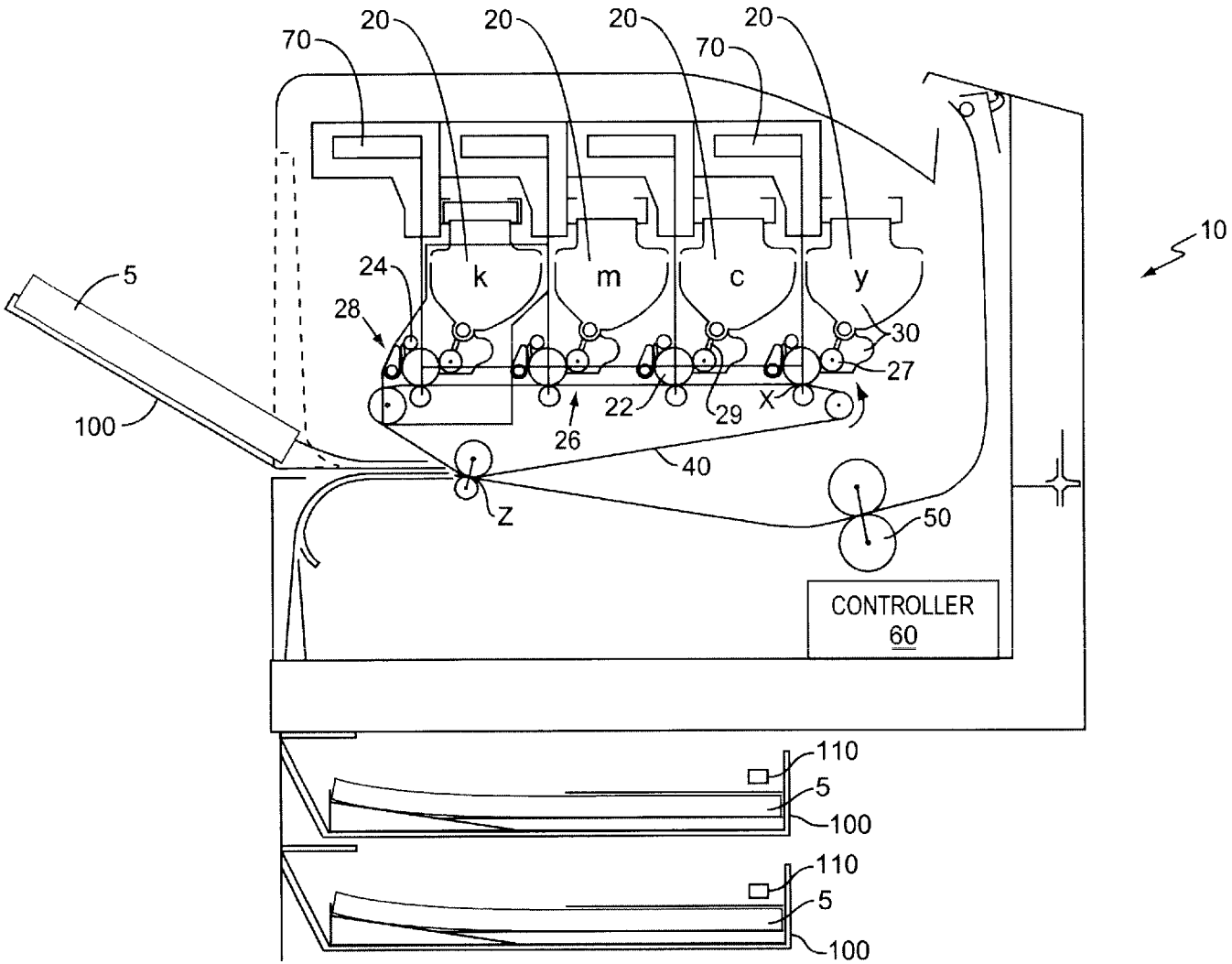
FIG. 1 shows an image forming apparatus.

A four color laser printer, generally designated 10 in FIG. 1, typically includes a plurality of optionally removable toner cartridges 20 that have different toner color contained therein, an intermediate transfer module 40, a fuser 50, and one or more recording media supplies 100. For instance, the printer 10 may include a black (k) cartridge 20, a magenta (m) cartridge 20, a cyan (c) cartridge 20, and a yellow (y) cartridge 20. Typically, each different color toner forms an individual image of a single color that is combined in a layered fashion to create the final multi-colored image, as is well understood in the art. Each of the toner cartridges 20 may be substantially identical; for simplicity only the operation of the cartridge 20 for forming yellow images will be described, it being understood that the other cartridges 20 may work in a similar fashion.

The toner cartridge 20 typically includes a photoconductor 22, a charger 24, a developer section 26, a cleaning section 28, and a toner supply bin 30. The photoconductor 22 is generally cylindrically-shaped with a smooth surface for receiving an electrostatic charge over the surface as the photoconductor 22 rotates past charger 24. The photoconductor 22 rotates past a scanning laser 70 directed onto a selective portion of the photoconductor surface forming an electrostatically latent image representative of the image to be printed. Drive gears (not shown) may rotate the photoconductor 22 continuously so as to advance the photoconductor 22 some uniform amount, such as 1/600th or 1/1200th of an inch, between laser scans. This process continues as the entire image pattern is formed on the surface of the photoconductor 22.

After receiving the latent image, the photoconductor 22 rotates to the developer section 26 which has a toner bin 30 for housing the toner and a developer roller 27 for uniformly transferring toner to the photoconductor 22. The toner is typically transferred from the toner bin 30 to the photoconductor 22 through a doctor blade nip formed between the developer roller 27 and the doctor blade 29. The toner is typically a fine powder constructed of plastic granules that are attracted and cling to the areas of the photoconductor 22 that have been discharged by the scanning laser 70. To prevent toner escape around the ends of the developer roller 27, end seals may be employed, such as those described in U.S. patent application Ser. No. 09/833,888, filed Apr. 12 2001, entitled "Dynamic End-Seal for Toner Development Unit," which is incorporated herein by reference.

The photoconductor 22 next rotates past an adjacently-positioned intermediate transfer module ("ITM"), such as belt 40, to which the toner is transferred from the photoconductor 22. The location of this transfer from the photoconductor 22 to the ITM belt 40 is called the first transfer point (denoted X in FIG. 1). After depositing the toner on the ITM belt 40, the photoconductor 22 rotates through the cleaning section 28 where residual toner is removed from the surface of the photoconductor 22, such as via a scraper well known in the art. The residual toner may be moved along the length of the photoconductor 22 to a waste toner reservoir (not shown) where it is stored until the cartridge 20 is removed from the printer 10 for disposal. The photoconductor 22 may further pass through a discharge area (not shown) having a lamp or other light source for exposing the entire photoconductor surface to light to remove any residual charge and image pattern formed by the laser 70.

As illustrated in FIG. 1, the ITM belt 40 is endless and extends around a series of rollers adjacent to the photoconductors 22 of the various cartridges 20. The ITM belt 40 and each photoconductor 22 are synchronized, via gears and the like well known in the art, so as to allow the toner from each cartridge 20 to precisely align on the ITM belt 40 during a single pass. By way of example as viewed in FIG. 1, the yellow toner will be placed on the ITM belt 40, followed by cyan, magenta, and black. The purpose of the ITM belt 40 is to gather the image from the cartridges 20 and transport it to the sheet 5 to be printed on.

The paper 5 may be stored in paper supply tray 100 and supplied, via a suitable series of rollers, belts, and the like, to the location where the sheet 5 contacts the ITM belt 40. At this location, called the second transfer point (denoted Z in FIG. 1), the toner image on the ITM belt 40 is transferred to the sheet 5. If desired, the sheet 5 may receive an electrostatic charge prior to contact with the ITM belt 40 to assist in attracting the toner from the ITM belt 40. The sheet 5 and attached toner next travel through a fuser 50, typically a pair of rollers with an associated heating element, that heats and fuses the toner to the sheet 5. The paper 5 with the fused image is then transported out of the printer 10 for receipt by a user. After rotating past the second transfer point Z, the ITM belt 40 is cleaned of residual toner in any conventional fashion, so that the ITM belt 40 is clean again when it next approaches the first transfer point X.

Figure 2:
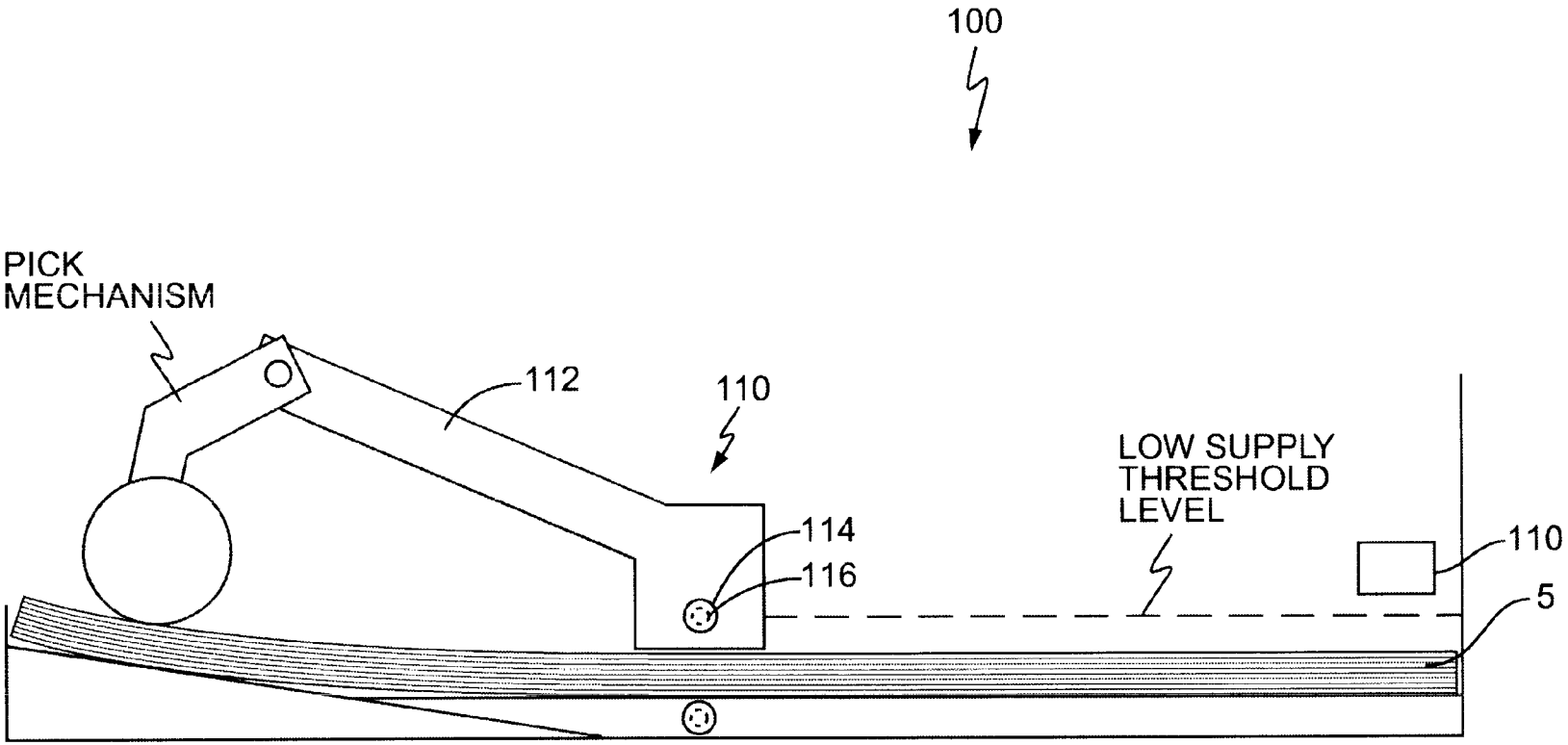
FIG. 2 shows one example of a media supply tray with one possible arrangement of a media supply level sensor useful with the present invention.

A recording media supply level sensor 110 (or "paper level sensor") may be used to monitor the supply of sheets 5 in the paper supply tray 100. The paper level sensor 110 should preferably be able to distinguish between three states—above a threshold, at or below the threshold but more than zero, and zero (paper out). Any one of numerous paper supply level sensors 110 known in the art may be used for such purpose, whether mechanical, optical, capacitive, or any other known type. One suitable arrangement, shown in FIG. 2, is for the paper supply level sensor 110 to include a moveable flag arm 112 that pivotally rests on the top of the paper stack in the paper supply 100, and a pair of optical emitter/detector pairs 114, 116 communicating with the controller 60 of the printer 10. One optical emitter/detector pair 114, 116 would be at a level corresponding to the threshold. As the paper supply level falls to the threshold, the flag arm 112 would interrupt the light from the emitter 114 to the detector 116, thereby telling the controller 60 that the threshold had been reached. Eventually, the last sheet is reached; as this sheet 5 is fed to the printing operation, the flag arm 112 should move (e.g., fall down through a hole normally blocked by the sheets 5) so as to interrupt the light from the second emitter 114 to the second detector 116, thereby telling the controller 60 that the paper out condition has been reached. Of course, the paper supply level sensor 110 may also be used to detect additional thresholds without departing from the present invention. Further, by employing the teachings of the present invention, the paper supply level sensor 110 may be positioned close to the exit point of the paper 5 from the paper supply tray 100, but this is not required. For example, FIG. 2 shows the flag arm 112 disposed farther upstream than the pick mechanism; however, the flag arm 112 may instead be disposed downstream of the pick mechanism. Indeed, in some arrangements, the flag arm 112 may be disposed outside the footprint of the sheets 5 in the paper supply tray 100, but connected to the pick mechanism so as to move appropriately in conjunction with the paper supply level in the paper supply tray 100.

The present invention addresses the problem of wasted toner due to image formation prior to detecting a paper out condition by increasing the gap between successive sheets 5 (the "interpage gap") when the paper supply level is low so that a paper out condition can be detected prior to forming the corresponding image at the toner cartridges 20.

Figure 3:
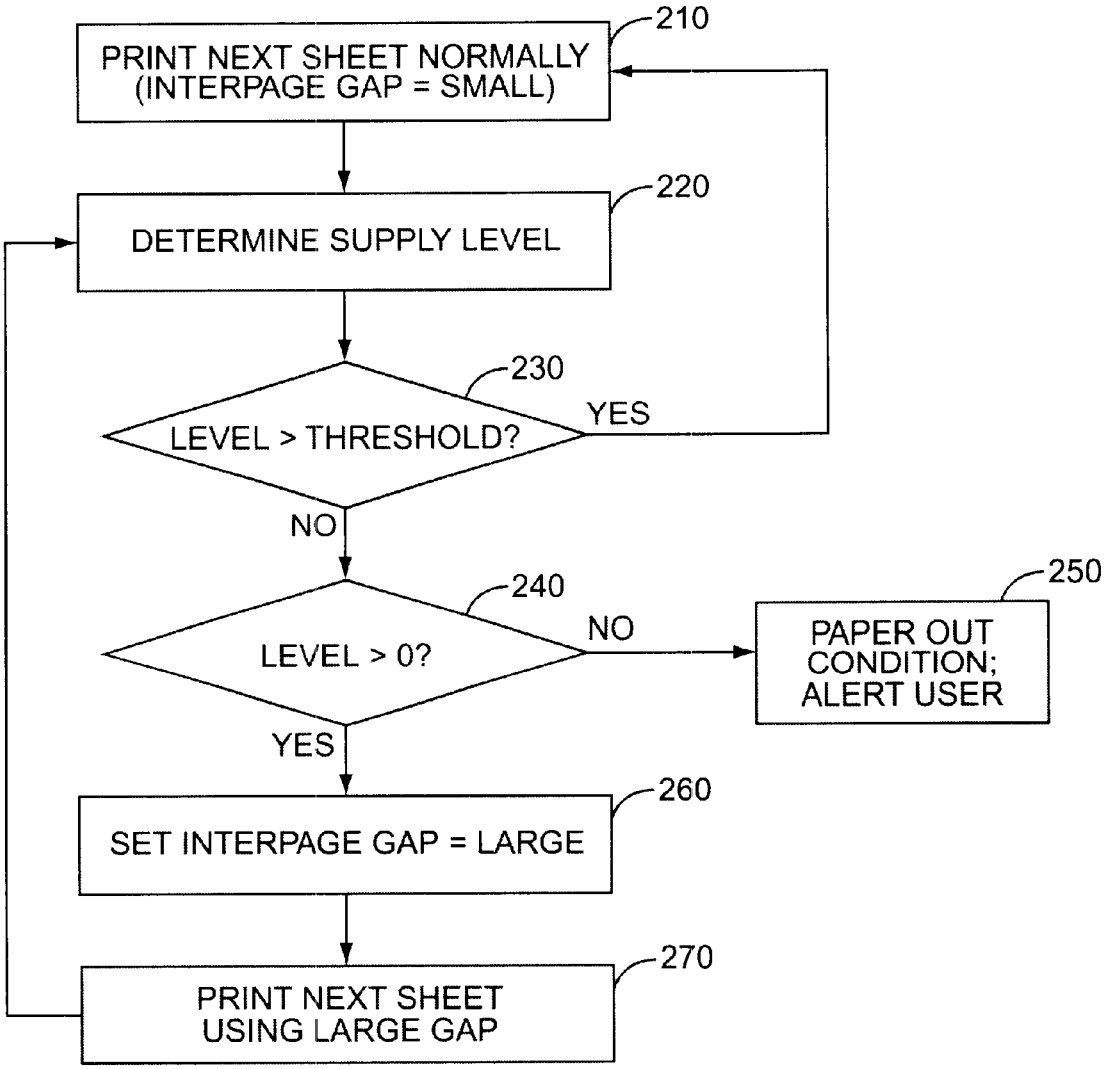
FIG. 3 shows one process flow according to the present invention.

The overall process flow may be seen in FIG. 3. The printer 10 prints using its normal interpage gap (box 210), such as two inches, while the paper supply level is above a first threshold level, such as above 10% full. The paper supply level is determined (box 220) by reference to the paper supply level sensor 110. If the supply level is above the threshold (box 230), the process returns to box 210. If the supply level is zero (box 240), corresponding to a paper out condition causing the printer 10 to alert the user in any fashion known in the art (box 250). If the supply level is more than zero (box 240), and necessarily below the threshold, this means that a low supply level has been detected. In response to the detection of the low supply level, the printer controller 60 increases the interpage gap to a second larger size, such as approximately thirteen inches (box 260). It should be understood that the actual value of the larger interpage gap will necessarily depend on the particular geometries of a given printer, especially the location of the paper sensor 10 relative to the rest of the paper supply tray 100 and any speed variations in the paper supply path. However, the second interpage gap is sized such that the previous sheet 5, (sheet N−1) will fully pass the relevant paper sensor 10 before the controller 60 initiates the image formation on the photoconductor 22 of the farthest upstream toner cartridge 20. Thus, if sheet N−1 is the last available sheet 5 in the paper supply 100, the paper sensor 110 will have time to note that there are no remaining sheets 5, meaning there is no sheet N available, and warn the controller 60, before the image starts being formed for the now-missing sheet N. The printer 10 is then ready to print the next sheet 5 using the larger interpage gap (box 270). The process then loops back to box 220.

As described above, the printer 10 may operate in three conceptual modes: 1) "normal mode" with a small interpage gap, preferably as small as possible given the considerations known in the art, when the paper supply level is above the threshold (e.g., level>10%); 2) "guard mode" with a larger interpage gap sufficient to allow the detection of a paper out condition prior to image formation, when the paper supply level is at or below the threshold but non-zero (e.g., 10%≦level<0); and 3) "paper out mode" when the paper out condition is sensed.

By increasing the interpage gap when the paper supply level is low, the present invention allows a paper out condition to be sensed before image formation for the next sheet begins, thereby conserving toner that would otherwise be wasted. While the approach of the present invention may have the effect of slightly decreasing throughput of the printer 10 when the paper supply is low, the toner savings may be significant. Indeed, provided that the threshold paper level is set relatively low, such as 10%, 6%, 5%, or less, the slower throughput should not be encountered very often. In addition, the larger the paper supply tray 100, the lower the threshold level may be set, as a percentage of full.

The discussion above has assumed that the response to a paper out condition will be a stoppage in printing. However, the present invention may also be applied in situations involving multiple paper supply trays 100. In such a situation, it may be advantageous to switch to a different paper supply tray 100 in response to a paper out condition for the first paper supply tray 100, rather than stopping printing entirely until the first paper tray 100 is refilled. Each paper supply tray 100 may advantageously have an associated recording media supply level sensor 110 and the controller 60 may be programmed to respond to the corresponding sensor 110 when feeding a given paper supply tray 100.

The discussion above has assumed that the recording media supply level sensor 110 performs the dual functions of determining the state of the media supply 100 with respect to the predetermined threshold level and detecting when the media supply is exhausted (commonly referred to as a "paper out" condition, or more generally as a "media-supply-out" condition). However, these conceptually distinct functions of the media supply level sensor 110 may optionally be divided amongst more than one sensor. For instance, a supply level sensor 110 may be used to determine whether the media supply 100 is in a normal state—corresponding to a supply somewhere between full and the threshold—or in a low supply level state—corresponding to a supply somewhere between the threshold and zero. A second sensor (not shown), distinct from the supply level sensor 110, could then be used to detect when the supply is exhausted—corresponding to a paper out condition. Of course, these two functions can be combined into one sensor 110, but this is not required.

The "normal" interpage gap in the discussion above has been illustratively set to two inches and the longer interpage gap has been illustratively set to approximately thirteen inches. However, these values are meant for illustrative purposes only as being suitable for 8½×11 paper in a particular design of printer 10, and not intended to be limiting. In general, it may be advantageous to apply to following logic to setting the respective interpage gap values:

Normal gap (default for 8½×11 paper):

=11 inches+2 inches (gap)−paper length, but not less than 2 inches.

Longer gap:

=11 inches+12⅞ inches (gap)−paper length, but not less than 12⅞ inches.

This logic may be easily implemented in the controller 60. Of course, the particular values for any given printer will depend on the geometry of that particular printer, particularly the path distance between the "paper-out" sensor 110 and the second transfer point Z, the path distance between the first transfer point X and the second transfer point Z, and the desired safety margin.

As used herein, the term "image forming apparatus" should be broadly construed; specifically including, but not limited to, laser printers, facsimile machines, copiers, and the like that use an electrophotographic image forming process of any variety.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. A method of conserving toner in an image forming apparatus, said image forming apparatus having a first sensor associated with a media supply adapted to detect the exhaustion thereof, said method comprising:

feeding a first discrete recording media from said media supply;

feeding a second discrete recording media from said media supply with a first interpage gap between said first media and said second media;

sensing a supply level state of said media supply;

feeding a third discrete recording media from said media supply with a second interpage gap between said second media and said third media in response to said sensed supply level state indicating a low supply level;

wherein said first interpage gap is such that said feeding said second media begins before said first sensor detects whether or not said first media is the last available media in said media supply; and wherein said second interpage gap is larger than said first interpage gap and sized such that said feeding said third media begins after said first sensor detects whether or not said second media is the last available media in said media supply.

2. The method of claim 1 further comprising sensing said media supply level state prior to said feeding said second discrete recording media from said media supply with said first interpage gap and wherein feeding said second discrete recording media from said media supply with said first interpage gap comprises feeding said second discrete recording media from said media supply with said first interpage gap in response to said sensed supply level state indicating a supply level between full and a predetermined level.

3. The method of claim 1 wherein said sensing said supply level state is performed by a sensor other than said first sensor.

4. The method of claim 1 wherein said image forming apparatus is an electrophotographic printer.

5. The method of claim 4 wherein said image forming apparatus is a color laser printer having multiple toner cartridges therein that help form toner images on an intermediate transfer medium prior to transfer to said recording media.

6. The method of claim 1 wherein said recording media is selected from the group consisting of sheet paper, transparencies, and envelopes.

7. The method of claim 1 wherein said low supply level corresponds to an approximately 5% supply level remaining in said media supply.

8. A method of conserving toner in a laser printer, said laser printer having a first sensor associated with a media supply adapted to detect the exhaustion thereof, said method comprising:

feeding a first discrete recording media from said media supply;

sensing a supply level state of said media supply and feeding a second discrete recording media from said media supply with a first interpage gap between said first media and said second media in response to said sensed supply level state indicating a supply level between full and a predetermined level;

again sensing the supply level state of said media supply and feeding a third discrete recording media from said media supply with a second interpage gap between said second media and said third media in response to said again sensed supply level state indicating a supply level above zero and not greater than said predetermined level;

forming images on said first, second, and third recording media via an intermediate transfer process using toner;

wherein said first interpage gap is such that said feeding said second media begins before said first sensor detects whether or not said first media is the last available media in said media supply;

wherein said second interpage gap is larger than said first interpage gap and sized such that said feeding said third media begins after said first sensor detects whether or not said second media is the last available media in said media supply; and wherein said sensing said supply level state is performed by said first sensor.

9. The method of claim 8 wherein said image forming apparatus is a color laser printer having multiple toner cartridges therein that help form toner images on an intermediate transfer module prior to transfer to said recording media.

10. The method of claim 8 wherein said pre-determined level corresponds to an approximately 5% supply level remaining in said media supply.

11. A method of feeding a plurality of discrete recording media in an image forming apparatus, comprising:

sensing a recording media supply level;

feeding successive recording media with a first interpage gap therebetween in response to said sensed supply level being above a first non-zero threshold;

feeding successive recording media with a second interpage gap in response to said sensed supply level being below said first threshold, wherein said second interpage gap is larger than said first interpage gap.

12. A method of printing a multi-sheet print job, comprising:

sensing a media supply level via a sensor having at least a normal state and a low supply state, said normal state corresponding to said supply level being above a predetermined level and said low supply state corresponding to said supply level being below said predetermined level;

based on said sensed level, feeding successive sheets to be printed:

with a first interpage gap in response to said sensor being in said normal state;

with a second interpage gap in response to said sensor being in said low supply state.

13. The method of claim 12 wherein said pre-determined level is in the range of approximately 10% to approximately 5% of capacity of a media supply tray.

14. An image forming apparatus, comprising:

at least one toner cartridge;

a supply of discrete recording media, said supply having a supply level;

a first sensor adapted to detect said supply level and having a first state and a second state that varies according to said supply level, said first state corresponding to said supply level above a predetermined level and said second state corresponding to said supply level below said predetermined level;

a media-supply-sensor adapted to detect when said supply of discrete recording media is exhausted;

wherein said image forming apparatus feeds successive discrete recording media towards a transfer location with a variable interpage gap therebetween, wherein said interpage gap corresponds to a first value when said first sensor is in said first state and corresponds to a second value, greater than said first value, when said first sensor is in said second state;

wherein said second value allows an opportunity for said media-supply sensor to detect if said supply of recording media is exhausted after recording media N−1 is fed from said supply prior to the image formation at said toner cartridge for recording media N.

15. The apparatus of claim 14 wherein said first value does not allow an opportunity for said media-supply sensor to detect if said supply of recording media is exhausted after recording media N−1 is fed from said supply prior to the image formation at said toner cartridge for recording media N.

16. A method of forming images within an image forming apparatus comprising:

feeding a first recording media from a first media supply;

feeding a second recording media from the first media supply with a first interpage gap between the first recording media and the second recording media;

sensing that a supply level within the first media supply is below a first predetermined level;

feeding a third recording media from the first media supply with a second interpage gap between the third recording media and the second recording media, the third interpage gap being larger than the first interpage gap;

sensing that the supply level within the first media supply is below a second predetermined level;

sensing that a second supply level within a second media supply is above a set level; and feeding a fourth recording media from the second media supply with a third interpage gap between the fourth recording media and the third recording media being less than or equal to the third interpage gap.

17. The method of claim 16, wherein the step of sensing that the supply level within the first media supply is below a second predetermined level comprising sensing that the first media supply is empty.

* * * * *